US007478440B2

(12) United States Patent
Dolenak

(10) Patent No.: US 7,478,440 B2
(45) Date of Patent: Jan. 20, 2009

(54) EXTRICATION GLOVE

(75) Inventor: Kenneth Dolenak, Moorpark, CA (US)

(73) Assignee: Ringers Resource, Inc.

( * ) Notice: Subject to any disclaimer, the term of this patent is extended or adjusted under 35 U.S.C. 154(b) by 134 days.

(21) Appl. No.: 11/405,955

(22) Filed: Apr. 17, 2006

(65) Prior Publication Data

US 2007/0245453 A1 Oct. 25, 2007

(51) Int. Cl.
*A41D 19/00* (2006.01)

(52) U.S. Cl. ..... 2/161.6; 2/163

(58) Field of Classification Search ..... 2/16, 2/20, 161.1, 161.6, 163
See application file for complete search history.

(56) References Cited

U.S. PATENT DOCUMENTS

| | | | | |
|---|---|---|---|---|
| 4,000,524 | A | 1/1977 | Rinehart | |
| 4,272,849 | A | 6/1981 | Thurston et al. | |
| 4,454,611 | A | 6/1984 | Tschirch et al. | |
| 4,766,612 | A * | 8/1988 | Patton, Sr. | 2/16 |
| 4,815,147 | A | 3/1989 | Gazzano et al. | |
| 5,016,286 | A | 5/1991 | Henriksen | |
| 5,349,705 | A | 9/1994 | Ragan | |
| 5,488,739 | A | 2/1996 | Cardinal | |
| 5,560,044 | A | 10/1996 | Masley | |
| 5,687,424 | A | 11/1997 | Masley | |
| 5,740,551 | A | 4/1998 | Walker | |
| 5,815,839 | A * | 10/1998 | Safford | 2/161.1 |
| 5,822,796 | A | 10/1998 | Harges, Jr. et al. | |
| 6,029,276 | A * | 2/2000 | White | 2/161.6 |
| 6,098,199 | A | 8/2000 | Barkin | |
| 6,389,601 | B2 | 5/2002 | Kleinert | |
| 6,415,443 | B1 | 7/2002 | Schierenbek et al. | |
| 6,415,445 | B1 * | 7/2002 | Nishijima et al. | 2/161.4 |
| 6,427,249 | B1 * | 8/2002 | Mattesky | 2/161.6 |
| 6,427,250 | B1 * | 8/2002 | Stull et al. | 2/161.6 |
| 6,536,050 | B1 | 3/2003 | Hill | |
| 6,559,453 | B2 | 5/2003 | Lundqvist | |
| 6,718,555 | B2 | 4/2004 | Hofmann | |
| 6,732,378 | B2 | 5/2004 | Novak | |
| 6,836,905 | B2 | 1/2005 | Sande | |
| 7,000,256 | B2 | 2/2006 | Kleinert | |
| 7,000,257 | B2 | 2/2006 | Bevier | |
| 2005/0183184 | A1 | 8/2005 | Hatch et al. | |
| 2006/0048259 | A1 * | 3/2006 | Keppler et al. | 2/21 |
| 2006/0048268 | A1 * | 3/2006 | Loos | 2/161.6 |
| 2007/0220655 | A1 * | 9/2007 | Aoki | 2/161.1 |

* cited by examiner

*Primary Examiner*—Katherine Moran
(74) *Attorney, Agent, or Firm*—Marc E. Hankin; Hankin Patent Law, APC

(57) ABSTRACT

This invention discloses a flame and heat resistant work glove that includes improved articulation systems for easier flexing of the finger joints and impact protection to safeguard the wearer's hands.

2 Claims, 3 Drawing Sheets

EXTRICATION GLOVE

FIELD OF INVENTION

This invention relates, generally, to work gloves; more particularly, to heavy-duty flame and heat resistant work gloves with articulating systems for enhanced flexibility of finger joints and impact protection for the wearer's fingers.

BACKGROUND

The art of work glove design has developed many gloves with improvements in the areas of comfort and flexibility, flame and heat resistance, and impact protection. One challenge faced by designers of work gloves is that, oftentimes, as flame and impact protection are increased, comfort and flexibility are compromised. Thus, work glove designers seek improvements that allow greater flame and impact protection while also improving comfort and flexibility. These improvements are especially desirable in the design of extrication gloves, where flexibility for dexterous movement of the fingers is desirable along with flame resistance and impact protection.

In the area of comfort and flexibility, numerous work gloves have been developed that allow the wearer's finger joints to flex more easily while in the glove. One such development is disclosed by U.S. Pat. No. 4,000,524 to Rinehart, which discloses an articulated glove construction. The fingers of Rinehart's glove are enhanced for greater flexibility in the joints by the inclusion of telescopic pleats at each of the finger joints in order that the fingers may be easily flexed. While disclosing an articulating mechanism, Rinehart fails to provide a means for combining greater flexibility with the advantages of flame and heat resistance and impact protection, which are desirable in extrication gloves.

Another such articulating mechanism is disclosed by U.S. Pat. No. 6,415,443 to Schierenbeck et al., which discloses a protective glove with enhanced finger joints for firefighters. The glove is enhanced by including wider sections at the finger and thumb joints, which facilitate easier flexing of the fingers. The Schierenbeck glove, however, fails to disclose a means by which the wearer's hand is also protected against impact.

Another such glove is disclosed by U.S. Pat. No. 6,427,249 to Mattesky, which discloses a heavy duty work glove that includes greater flexibility and enhanced friction gripping by including strips of friction grip enhancing elements sewn across the palm of the glove. Mattesky's glove, however, also fails to disclose a means for improving flexibility while maintaining flame and impact protection.

Another articulating mechanism is disclosed by U.S. Pat. No. 6,732,378 to Novak, which discloses a glove with tucks located at the fourchette of each finger in order to improve flexibility. While directed towards improving flexibility and reducing hand fatigue of the wearer, Novak's glove fails to disclose a system that includes effective flame and heat resistance and impact protection. In summary, while representing improvements in the area of flexibility and comfort, the above designs fail to disclose a glove design that is flexible, while maintaining flame and heat resistance and impact protection.

Another class of work gloves has been developed in order to protect the wearer from flame and heat resistance. U.S. Pat. No. 4,454,611, for example, to Tschirch et al. discloses a fireproof glove that includes a layer of flame resistant elastomer. Tschirch's glove, however, fails to disclose a means of combining flame resistance with enhanced flexibility and impact protection.

Another such glove is disclosed by U.S. Pat. No. 5,349,705 to Ragan, which discloses a multi-layered firefighter's glove. Similarly, U.S. Pat. No. 5,740,551 to Walker discloses a multi-layered protective glove with a liquid impenetrable layer beneath a flexible outer layer. Both Ragan and Walker's gloves, however, fail to disclose a system that includes enhanced flexibility and impact protection.

One flame resistant glove that includes enhancements for improved flexibility is disclosed by U.S. Pat. No. 5,822,796 to Harges, Jr. et al. Harges, Jr. discloses a protective glove for firefighters that includes a relatively thin inner-protective glove which is covered by an outer portion of fire resistant material and insulation batting. In one embodiment of the invention, the Harges, Jr. glove includes lateral indentations, flex joints, accordion folds, or lateral cut-outs at the finger joints in order to enhance flexibility. The Harges, Jr. glove, however, fails to disclose a glove that includes a system for impact protection. Also, because the insulating batting material is relatively thick, the glove is better suited to work such as fighting wildland fires, where subtle movement of the fingers is not necessary. Thus, the glove is unsuitable for certain applications, such as extrication, where impact protection and dexterous movement of the fingers are desirable.

Another class of gloves has been developed to prove the wearer with impact protection for work and sports applications. U.S. Pat. No. 4,272,849 to Thurston, et al., for example, discloses a work glove with steel plates included between the layers of the glove and protecting the proximal, middle, distal phalanx. Because the steel plates do not extend to the finger joints, they do not substantially interfere with the flexing of the finger. The Thurston glove, however, is relatively heavy and unwieldy because of the inclusion of metallic materials and fails to disclose a system for flame resistance.

Several gloves, particularly for the sport of hockey, have been developed, which offer the wearer a great deal of impact protection by including a layer of pads that covers the outside of an inner glove. The pads, however, are bulky and tend to limit the flexibility of the glove. U.S. Pat. No. 4,815,147 to Gazzano et al. and U.S. Pat. No. 5,488,739 to Cardinal disclose mechanisms for improving the flexibility of these padded sports gloves. Gazzano's glove features beveled edges at the protective pads in order to allow easier flexing of the wearer's joints. Cardinal's glove, meanwhile, features a flexible web of material at the finger joints in order to allow easier flexing, while protecting the joints of the finger. Both of these gloves, however, a relatively heavy and unwieldy and, thus, unsuited to applications, such as extrication, where dexterous movement of the fingers is required. Also, neither glove discloses a design that is flame or heat resistant.

Several other gloves have been developed specifically for extrication and include varying degrees of impact protection and flame and heat resistance. None of these gloves, however, discloses a means for providing the wearer with enhanced flexibility of the fingers while maintaining flame and impact resistance.

Thus, there remains a long-felt need in the art for a heavy-duty work glove that affords the wearer flame resistance and impact protection, and includes a system for easier articulation of the finger joints.

SUMMARY OF THE INVENTION

This invention is directed towards overcoming the above shortcomings by teaching a flame and heat resistant glove that includes impact protection and a system for enhancing the flexibility of the finger joints. This combination of these elements makes this glove particularly well suited to demanding work conditions, such as extrication, where flame resistance and impact protection are desirable, as well as dexterous movement of the fingers.

In one embodiment, the invention comprises an improved construction of the glove in the areas covering the top of one or more of the wearer's fingers. In one embodiment of the invention, this area of the glove is comprised of alternating bands of a first material that is flexible and a second material that is semi-rigid, flame and heat resistant, and provides impact protection. Unlike the prior art, which typically uses a first, flexible material for an inner glove and adds, over the first material, pads or another more robust second material for impact and flame protection, the first and second materials are featured in alternating bands that extend the length of the finger. The first material is generally placed in areas coving the joints of the finger while the second material is generally used in areas covering the phalanx bones. The second material also covers the knuckles at the proximal inter-phalangeal joint. The first and second materials are sewn, end-to-end, to one another or attached by any of the attachment means known in the art, thus allowing easier articulation of the fingers. In this manner, the glove's wearer is protected while being allowed nuanced and dexterous movement of the fingers.

In one embodiment of the invention, the first, flexible material is any of the cloths or fabrics typically used in work glove construction and the second, semi-rigid material is silicone. Silicone offers several advantages in glove construction because it provides flame and heat resistance while also providing impact protection to the wearer. Other flame resistant and robust materials are also known in the art and are within the contemplation of the invention.

In another embodiment of the invention the semi-rigid material is thermoplastic rubber. The thermoplastic rubber may be manufactured with an embedded layer of fabric in order to add resilience, strength, and durability to the thermoplastic rubber.

In another embodiment of the invention, the semi-rigid material includes a plurality of grooves, which allow the semi-rigid material to more easily flex.

In yet another embodiment of the invention, one or more of the flexible materials used on one or more of the fingers of the glove is made of a material that is highly reflective to light.

In yet another embodiment of the invention, a knit, mesh garment liner is attached beneath the flexible and semi-rigid materials in order to support the attachment of the flexible and semi-rigid material.

In yet another embodiment of the invention, the glove includes an inner glove, made from a relatively thin material for the comfort of the wearer and in order to further protect the hands of the wearer.

In yet another embodiment of the invention, between the inner glove and the outer glove, a liquid impenetrable glove is included in order to protect the wearer from liquid intrusion, chemical intrusion, blood-borne contaminants, and further such intrusion into the glove.

In yet another embodiment of the invention, the glove features a knuckle guard, which is manufactured from the semi-rigid material used in the fingers of the gloves. The knuckle guard is positioned on the top of the glove in order to protect the metacarpophalangeal knuckle and the top of the hand.

In yet another embodiment of the invention, the glove features para-aramid synthetic fiber, such as Kevlar® sections at the palm of the hand in order to protect the palm and fingers.

DETAILED DESCRIPTION OF THE DRAWINGS

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/ or components have not been described in detail so as not to unnecessarily obscure aspects of embodiments of the invention.

In the following description, certain terminology is used to describe certain features of one or more embodiments of the invention. For instance, "glove" refers to any of various coverings for the hand designed to provide protection and/or improve the grip; "fabric" refers to any vinyl, canvas, fabric, or other material commonly used in glove construction; and "fireproof material" refers to any silicone, fireproof rubber, fire treated leather, fire treated fabric, aluminized fiberglass fabric, knit or woven fire resistance fibers or polymers, and any other such materials known in the art.

Figure 1:
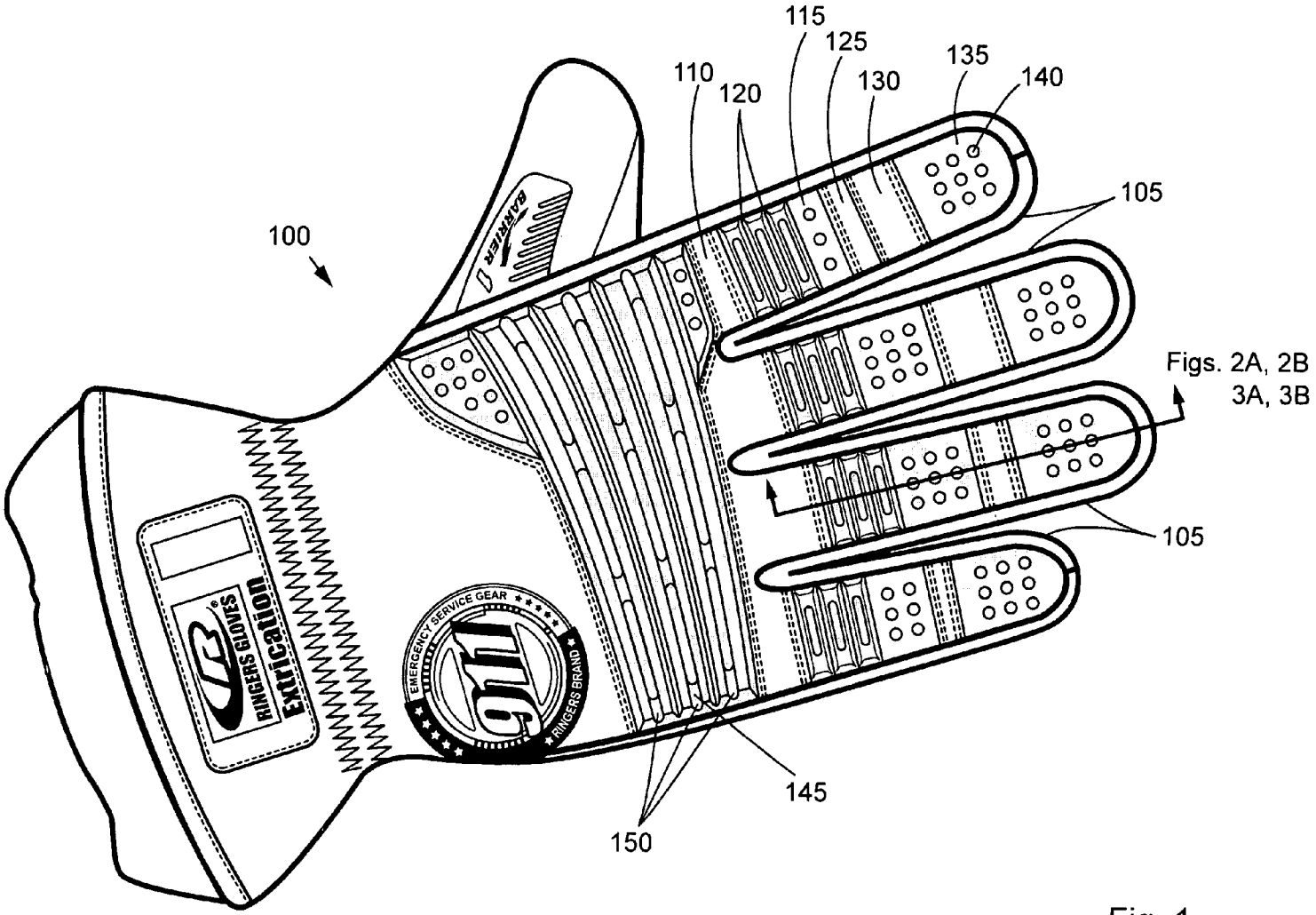
FIG. 1 is an illustration from a top view of the extrication glove.

FIG. 1 is an illustration from a top view of the extrication glove. A glove 100 is shown, which features elements of one embodiment of the invention at the finger sections 105 of the glove 100. A typical finger section 105 includes a first flexible band 110 comprised of a flexible, clothlike fabric. Attached to the first flexible band 110 is a first semi-rigid band 115, comprised of a semi-rigid fireproof material that protects the tops of the fingers and the knuckles of the proximal inter-phalangeal joint. The first semi-rigid band 115 features grooves 120, which allow for easier flexibility in the fingers. Attached to the first semi-rigid band 115, is a second flexible band 125, comprised of a flexible clothlike fabric. The second flexible band 125 includes a reflective region 130, comprised of a material that is highly reflective of light. Attached to the second flexible band 125 is a second semi-rigid band 135, also comprised of a semi-rigid fireproof material. The first 115 and second 135 semi-rigid bands feature studs 140, which provide the wearer with greater impact protection. By attaching the bands in this manner, end-to-end, the invention achieves greater flexibility in the fingers than conventional gloves or the prior art. The glove 100 further features a knuckle guard 145, with grooves 150 for easier articulation, that is configured to protect the knuckle of the metacarpophalangeal joint.

Figure 2A:
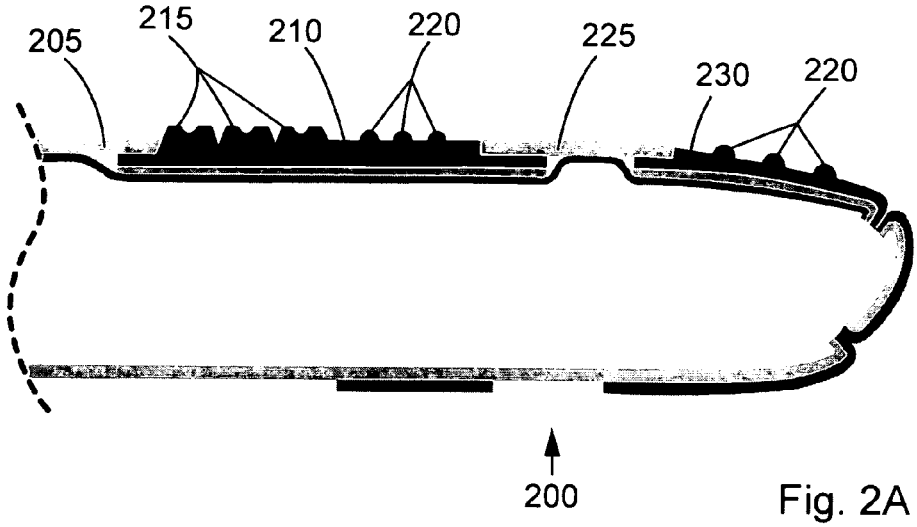
FIG. 2A is an illustration from a cross sectional view of the finger portion of the glove in one embodiment of the invention.

FIG. 2A is an illustration from a cross sectional view of the finger portion of the glove in one embodiment of the invention. The finger section 200 of a typical glove is illustrated along with its constituent parts, including: a first flexible band 205, a first semi-rigid band 210, a second flexible band 225, and a second semi-rigid band 230. The first semi-rigid band 210 features grooves 215, which allow for flexibility and studs 220 for greater impact protection. The second semi-rigid band 230 also features studs 220 for greater impact protection.

Figure 2B:
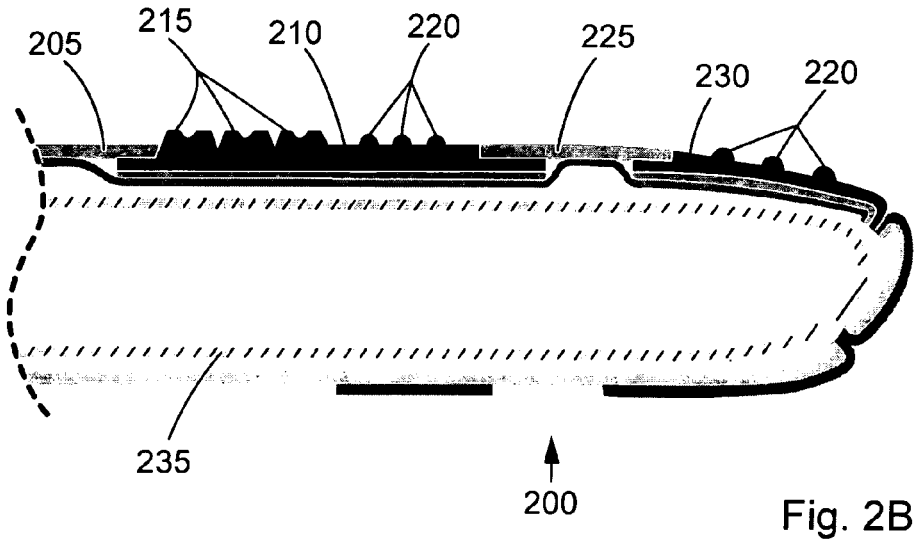
FIG. 2B is an illustration from a cross sectional view of the finger portion of the glove in one embodiment of the invention.

FIG. 2B is an illustration from a cross sectional view of the finger portion of the glove in one embodiment of the invention. The finger section 200 of a typical glove is illustrated along with its constituent parts, including: a first flexible band 205, a first semi-rigid band 210, a second flexible band 225, and a second semi-rigid band 230. The first semi-rigid band 210 features grooves 215, which allow for flexibility and studs 220 for greater impact protection. The second semi-rigid band 230 also features studs 220 for greater impact protection. This embodiment of the invention also features an inner glove 235 for greater comfort and protection.

Figure 3A:
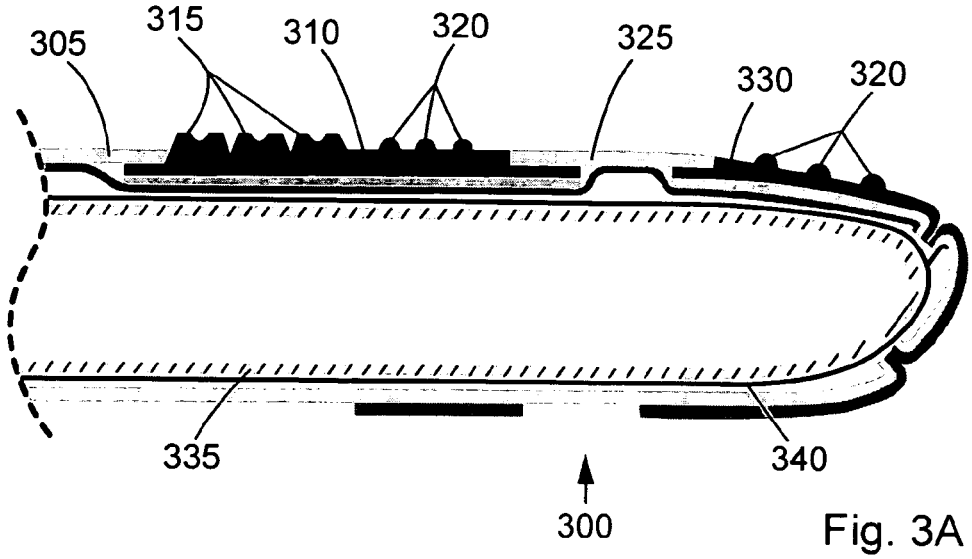
FIG. 3A is an illustration from a cross sectional view of the finger portion of the glove in one embodiment of the invention.

FIG. 3A is an illustration from a cross sectional view of the finger portion of the glove in one embodiment of the invention. The finger section 300 of a typical glove is illustrated along with its constituent parts, including: a first flexible band 305, a first semi-rigid band 310, a second flexible band 325, and a second semi-rigid band 330. The first semi-rigid band 310 features grooves 315, which allow for flexibility and studs 320 for greater impact protection. The second semi-rigid band 330 also features studs 320 for greater impact protection. This embodiment of the invention also features an inner glove 235 and a liquid impenetrable glove 340. The inner glove 335 provides greater comfort and protection while the liquid impenetrable glove 340 protects the wearer against liquid, chemical, or blood borne contaminants.

Figure 3B:
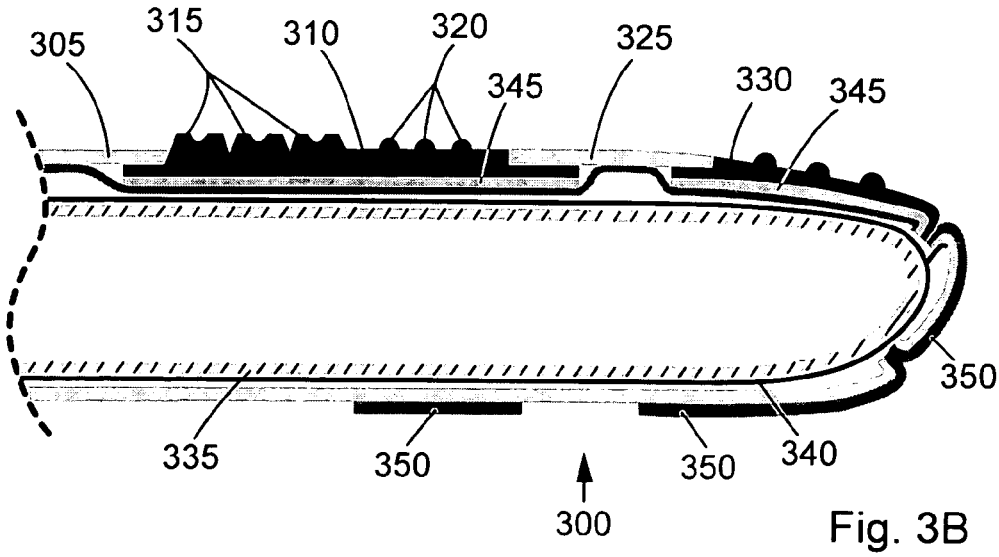
FIG. 3B is an illustration from a cross sectional view of the finger portion of the glove in one embodiment of the invention.

FIG. 3B is an illustration from a cross sectional view of the finger portion of the glove in one embodiment of the invention. The finger section 300 of a typical glove is illustrated along with its constituent parts, including: a first flexible band 305, a first semi-rigid band 310, a second flexible band 325, and a second semi-rigid band 330. The first semi-rigid band 310 features grooves 315, which allow for flexibility and studs 320 for greater impact protection. In this embodiment, the semi-rigid material is thermoplastic rubber, which is fused with fabric 345, for greater strength and rigidity. This embodiment further features para-aramid synthetic fiber, such as Kevlar® sections 350 at the finger tip and underside of the fingers for greater protection of the wearer's hand. This embodiment of the invention also features an inner glove 235 and a liquid impenetrable glove 340. The inner glove 335 provides greater comfort and protection while the liquid impenetrable glove 340 protects the wearer against liquid, chemical, or blood borne contaminants.

I claim:

1. A work glove, comprising:

a first section covering a top of one or more fingers of a hand comprising, a first material, said first material being generally pliable, a second material, said second material being more rigid than said first material, said first section covering said top of said one or more fingers of said hand being configured such that said first material and said second material are arranged in alternating bands, said bands generally extend the width of said one or more fingers and include one or more bands of said first material and one or more bands of said second material, one or more edges of said one or more bands of said first material being attached to one or more edges of said one or more bands of said second material, and a second section covering one or more metacarpophalangeal knuckles and a top of said hand, wherein said second section is comprised of said second material, and a third section covering portions of a palm and an underside of said fingers of the hand comprised of a third material, wherein said third material is generally more rigid than said first material.

2. A work glove according to claim 1, wherein said first material is comprised of vinyl, said second material is comprised of thermoplastic rubber fused with fabric, and said third material is comprised of para-aramid synthetic fiber.

* * * * *